US010301165B2

(12) United States Patent
Leyva et al.

(10) Patent No.: US 10,301,165 B2
(45) Date of Patent: May 28, 2019

(54) VERSATILE AND AESTHETICALLY REFINED KEG DISPENSER

(71) Applicants: Robert Leyva, Roswell, NM (US); Timothy Crawford, El Paso, TX (US); Juan Delgado, Albuquerque, NM (US)

(72) Inventors: Robert Leyva, Roswell, NM (US); Timothy Crawford, El Paso, TX (US); Juan Delgado, Albuquerque, NM (US)

(73) Assignee: Ascero Technologies, LLC, El Paso, TX (US)

( * ) Notice: Subject to any disclaimer, the term of this patent is extended or adjusted under 35 U.S.C. 154(b) by 0 days.

(21) Appl. No.: 15/136,373

(22) Filed: Apr. 22, 2016

(65) Prior Publication Data

US 2016/0236926 A1 Aug. 18, 2016

Related U.S. Application Data

(63) Continuation of application No. PCT/US2014/061963, filed on Oct. 23, 2014.

(Continued)

(51) Int. Cl.

| | |
|---|---|
| ***B67D 1/00*** | (2006.01) |
| ***B67D 1/12*** | (2006.01) |
| ***B67D 1/04*** | (2006.01) |
| ***B67D 1/06*** | (2006.01) |
| ***B67D 1/08*** | (2006.01) |

(52) U.S. Cl.

CPC ..... *B67D 1/1245* (2013.01); *B67D 1/04* (2013.01); *B67D 1/0406* (2013.01); *B67D 1/06* (2013.01); *B67D 1/0868* (2013.01); *B67D 1/0872* (2013.01); *B67D 1/0895* (2013.01); *B67D 2001/082* (2013.01); *B67D 2210/00031* (2013.01); *B67D 2210/00034* (2013.01); *B67D 2210/00041* (2013.01)

(58) Field of Classification Search

CPC ..... B65D 1/1245; B65D 1/04; B65D 1/0406; B65D 1/06; B65D 1/0868; B65D 1/0895; B65D 1/0074; B65D 1/0861; B65D 1/0004; F25D 23/026; F25D 23/028; F25D 23/021; F25D 2331/802; F25D 2331/806; B67D 1/06; A47B 77/08

USPC ..... 222/146.6, 146.1, 182, 183, 146.2, 222/129.1–129.4

See application file for complete search history.

(56) References Cited

U.S. PATENT DOCUMENTS

| | | | | |
|---|---|---|---|---|
| 242,254 A * | 5/1881 | Bird | ..... | B65D 43/00 116/DIG. 33 |
| 1,080,478 A * | 12/1913 | Reis | ..... | B65D 47/40 220/252 |

(Continued)

FOREIGN PATENT DOCUMENTS

| | | |
|---|---|---|
| DE | 90 06 681 | 8/1990 |
| DE | 102007005037 | 8/2008 |

(Continued)

*Primary Examiner* — Charles Cheyney
(74) *Attorney, Agent, or Firm* — Peacock Law P.C.; Janeen Vilven

(57) ABSTRACT

A keg dispenser for dispensing and housing a beverage contained within a keg the dispenser comprising an upper column, a keg compartment, and a spigot. The dispenser allows the user to switch from one type of beverage to another with minimal adjustments all while maintaining an eye pleasing yet compact design.

10 Claims, 18 Drawing Sheets

Related U.S. Application Data

(60) Provisional application No. 61/964,852, filed on Jan. 16, 2014, provisional application No. 61/961,789, filed on Oct. 24, 2013.

(56) References Cited

U.S. PATENT DOCUMENTS 2,063,171 A * 12/1936 Kucher ..... F25D 31/006 222/146.1
2,063,507 A * 12/1936 Karper ..... B65F 1/08 220/263
2,080,786 A * 5/1937 Robles ..... B65D 43/00 160/132
2,109,718 A 3/1938 Bayers
2,223,152 A 11/1940 Nagin
D143,887 S 2/1946 Thompson
2,414,929 A * 1/1947 Civkin ..... F25D 25/027 126/338
2,596,316 A * 5/1952 White ..... F25D 11/00 220/213
2,744,672 A 5/1956 Crist
2,774,229 A * 12/1956 Thau ..... B67D 1/04 222/146.6
2,792,692 A * 5/1957 Bryan ..... B67D 1/04 222/146.6
3,482,801 A * 12/1969 Leontas ..... B65G 51/06 220/255
3,599,371 A * 8/1971 Barroero ..... F25D 23/021 49/30
3,712,514 A * 1/1973 LeBlanc ..... B67D 1/04 222/146.6
3,865,276 A 2/1975 Thompson
3,885,711 A * 5/1975 Martindale ..... B67D 1/0887 222/146.1
D241,219 S 8/1976 Martin
3,979,024 A * 9/1976 Hoppe ..... B67D 1/0857 137/574
4,225,059 A 9/1980 Kappos
4,350,267 A * 9/1982 Nelson ..... B67D 1/04 222/131
D271,877 S 12/1983 Hoff
4,497,348 A * 2/1985 Sedam ..... B67D 1/0021 137/44
D285,052 S 8/1986 Bianchi et al.
4,690,300 A * 9/1987 Woods ..... A47G 23/04 220/264
D298,602 S 11/1988 Price
D300,106 S 3/1989 Paulin
4,901,887 A 2/1990 Burton
D311,298 S 10/1990 Mollenhoff
D352,296 S 11/1994 Westendorf
5,379,916 A 1/1995 Martindale et al.
D367,864 S * 3/1996 Lacewell ..... D15/85
D368,271 S * 3/1996 Montgomery ..... D15/81
5,537,825 A 7/1996 Ward
D399,088 S 10/1998 Chaney
5,941,103 A 8/1999 Stearns
D415,023 S 10/1999 Snyder
5,992,684 A * 11/1999 Russell ..... B67D 1/006 222/1
D423,862 S 5/2000 Mravlja, Jr. et al.
6,237,345 B1 5/2001 Kalman et al.
6,502,415 B2 1/2003 Chiusolo
D469,787 S 2/2003 Wicker
6,626,317 B2 * 9/2003 Pfiefer ..... B65F 1/16 220/263
D482,227 S 11/2003 Walton
D489,214 S 5/2004 Noda et al.
6,783,034 B1 8/2004 Brent
7,150,163 B1 12/2006 McAllister
D538,641 S 3/2007 Limber
7,225,951 B2 * 6/2007 Wempe ..... A63B 55/00 222/192
7,237,390 B1 7/2007 Nelson
D555,967 S 11/2007 Rasmussen
7,343,757 B2 3/2008 Egan et al.
D588,852 S 3/2009 Stein
D617,603 S 6/2010 Garman
7,752,876 B2 * 7/2010 Meekma ..... F16K 35/10 70/164
7,757,908 B1 * 7/2010 Buhl, Jr. ..... B67D 1/0406 141/231
D640,569 S 6/2011 Alongi
7,975,879 B2 * 7/2011 Groesbeck ..... B65D 5/4204 220/4.01
D646,104 S 10/2011 Zhou et al.
8,217,613 B2 * 7/2012 Yoo ..... A47B 88/0414 318/280
8,231,036 B2 * 7/2012 Campbell ..... B60R 9/065 224/42.32
D677,102 S 3/2013 Walton et al.
8,496,308 B2 7/2013 Zabbatino
D691,643 S 10/2013 Sharkey
D697,748 S 1/2014 Wang et al.
8,789,726 B2 * 7/2014 Segers ..... B67D 1/0834 222/146.6
D722,806 S 2/2015 Leyva
D734,086 S 7/2015 Tseng et al.
9,073,741 B2 * 7/2015 Jannatkhah ..... B67D 1/0858
D735,514 S 8/2015 Cheung et al.
D736,024 S 8/2015 Taubman et al.
D752,374 S 3/2016 Leyva
9,809,238 B2 * 11/2017 Kincaid ..... B62B 1/264
2002/0050496 A1 5/2002 Van Der Meer
2006/0011664 A1 * 1/2006 Hammond ..... B67D 1/0406 222/399
2010/0206890 A1 * 8/2010 Segers ..... B67D 1/0801 220/592.18
2010/0276444 A1 11/2010 Belcham
2011/0017776 A1 * 1/2011 Metropulos ..... B67D 1/0888 222/129.1
2011/0168775 A1 * 7/2011 Van Zetten ..... G07F 13/065 235/381
2012/0132673 A1 5/2012 Leyva et al.
2013/0061762 A1 3/2013 Carr et al.
2014/0110018 A1 * 4/2014 Scarvelli ..... B67D 3/0032 141/64

FOREIGN PATENT DOCUMENTS

JP S39-010268 4/1959
JP S61-130151 8/1986
JP S64-042298 3/1989
JP H06-054597 7/1994
JP 3037947 3/1997
WO 93/23327 11/1993
WO 2008/147200 12/2008
WO 2013/105962 7/2013
WO 2015/061564 4/2015

* cited by examiner

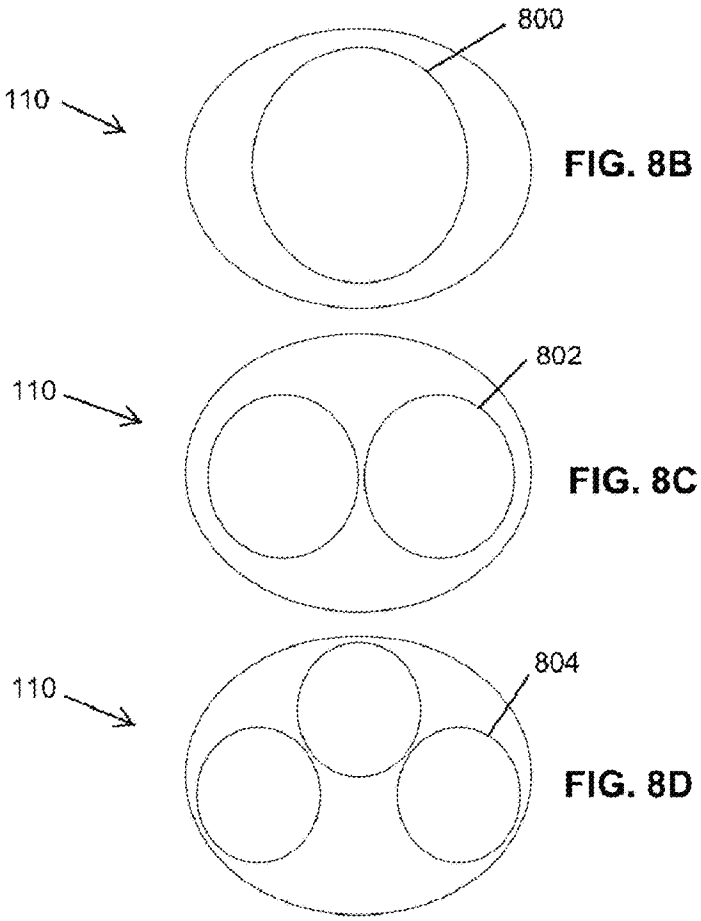
FIG. 8B
FIG. 8C
FIG. 8D
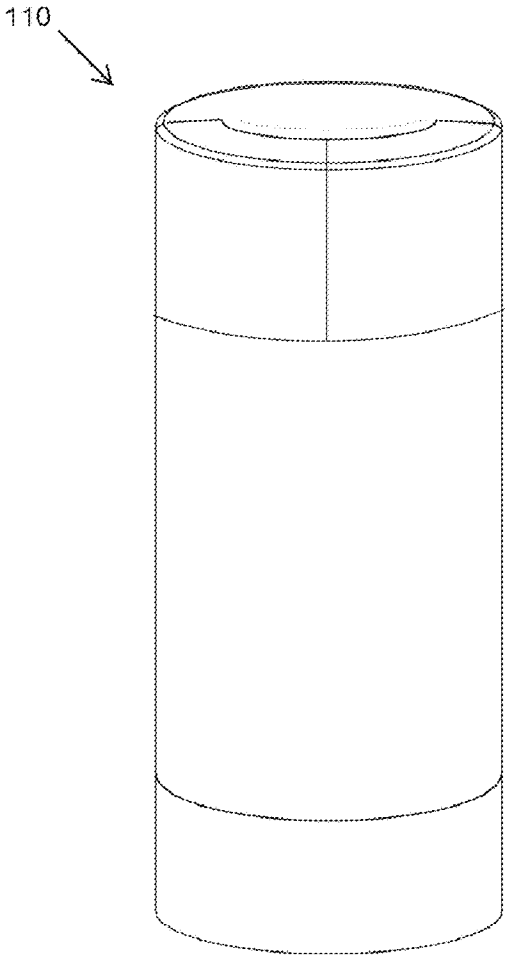
FIG. 8A

VERSATILE AND AESTHETICALLY REFINED KEG DISPENSER

CROSS-REFERENCE TO RELATED APPLICATIONS

This application is a continuation application of International Application No. PCT/US2014/061963, entitled "Versatile and Aesthetically Refined Keg Dispenser", filed on Oct. 23, 2014, which claims priority to and the benefit of the filing of U.S. Provisional Application No. 61/961,789, entitled "Foam Resistant Draft Dispenser with Concealable Faucet", filed on Oct. 24, 2013, and U.S. Provisional Application No. 61/964,852, entitled "Foam Resistant Draft Dispenser with Concealable Faucet", filed Jan. 16, 2014, and the specification thereof is incorporated herein by reference.

BACKGROUND OF THE INVENTION

Field of the Invention (Technical Field)

There are typically two types of keg dispensers readily available for home use. One, in its simplest form, is a boxed refrigerator with a column setting on top. The "column", as it is generally referred to within the beer industry, is a cylindrical tube having an outside diameter of approximately four inches and an inside diameter of approximately three inches. The column is normally disposed on top of a refrigerated housing comprising tubing that connects the keg to the spigot. The tubing also limits airflow through the column. A spigot is also attached to the column. Aside from an unsightly appearance, such a configuration also makes it difficult to adequately cool the section of tubing housed within the column. Because beer which is not properly cooled has a tendency to foam excessively when dispensed into a drinking container, such known devices are plagued with chronic foaming. To combat this problem, some high-end residential units utilize a separate blower which forces cool air directly into the column in order to minimize foaming. However, this additional hardware increases the cost of the unit, thereby preventing the average consumer from purchasing it.

The second type of dispenser is a modified refrigerator with the spigot attached directly to the door of the refrigerator. This type is not manufactured. Instead, it is typically sold as a kit to be installed by the purchaser and requires drilling into the front door of a standard residential refrigerator, thereby defacing it and possibly damaging the refrigerator, and likely voiding the manufacturer's warranty. Yet another problem with this known arrangement is that average individuals lack the basic knowledge of how draft works, thus making such piecemeal kit-systems problematic. Still further, another aspect of such an arrangement, viewed by some as unfavorable, is having the spigot and drip tray protrude from the front of the refrigerator door where aside from being unsightly, could prove to be a possible hazard (i.e. snagging of clothing or injury due to bumping with force).

While there may be other arrangements for dispensing kegs, they are typically reserved for commercial use due to the high cost of the equipment, installation and high maintenance associated with running such devices; they are not conducive for use in a residential setting.

Ideally, a keg dispenser should be easy to operate and maintain with little or no issues with product loss due to foam and should be aesthetically pleasing.

Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

U.S. Pat. No. D 469,787 to Wicker discloses a keg cooler ornamental in design where the dispenser has a cylindrically contoured front to wrap around the keg. The dispenser column, however, is still located on the top outside of the housing thus operating as a typical keg cooler with dispenser column on top of the housing.

U.S. Pat. No. D 352,296 to Westendorf illustrates a keg-shaped keg cooler. Although ornamental, the design serves no utilitarian purpose.

U.S. Pat. No. 6,502,415 to Chiusolo et al. discloses a cooling system requiring the use of water and ice circulated over conduits by agitators to keep beer from foaming. This is arrangement is only useful in an off-grid setting where conventional refrigeration is not available. U.S. Pat. No. 4,225,059 to Kappos, U.S. Pat. No. 3,865,276 to Thompson and U.S. Pat. No. 2,223,152 to Nagin, also describe methods that are useful where typical refrigeration-techniques are not available or not preferred. Both of these systems lack a refrigeration unit, thus making them unsuitable for daily residential or commercial use.

U.S. Pat. No. 7,237,390 to Nelson discloses a portable cooling unit for use during social gatherings. Although the system provides desirable results for events lasting a few days, it is not useful for routine home use, where a keg may last weeks or months before being consumed. This is because Nelson's system fails to cool the entire keg, thus causing the beer to spoil in a short time. This system also lacks the ability to conceal the spigots from the public's view.

Another issue with current keg dispensers is the shear size of the units. For the most part, they are designed to house large ½ barrel kegs, which are typically used in commercial settings. This gives the appearance of a bar or frat house to the location in which they are housed. There are also a growing number of kegs being used to distribute craft or specialty beers. These are known as slim ¼ or slim 5 gallon kegs. These smaller kegs, generally referred to as "slim kegs" are also favored by a growing sect of home brewers. There is currently no known cylindrical dispenser designed specifically for these slim kegs. Another major issue impeding the proliferation of draft dispensers for home use is the lack of outlets for dispensing gases such as CO2, Nitrogen, Beer Gas, etc. is the lack of outlets and the hassle of getting tanks filled is a contributing factor in the decision not purchase draft for home use.

There is thus a present need for an apparatus that dispenses slim kegs, typical ½ barrel kegs and a growing number of smaller kegs ranging from less than 1 gallon up to 15.5 gallons or more while maintaining a compact size. Particularly, an apparatus which is easier to maintain and operate and which ensures proper cooling and thus avoids the foaming issues that are so prolific in known keg dispensers. It also must incorporate more convenient methods to manage multiple gases used to propel and maintain the integrity of the product dispensed. There is further a need for a keg-dispensing apparatus which includes an outer-housing that is shaped to fit within the décor of a home or trendy sports bar.

BRIEF SUMMARY OF THE INVENTION

An embodiment of the present invention relates to a beverage dispensing apparatus that includes a keg compartment and an upper column having one or more upper doors and a spigot that is concealed when the doors are closed. In one embodiment the keg compartment is cooled by a cooling unit. The cooling unit can operate on the principal of adiabatic cooling of a compressed refrigerant and/or include a Peltier-effect-based thermo electric cooler. In one embodiment, the keg compartment can include a door which has a drip tray disposed in an upper end thereof. The keg compartment can be disposed below the upper column. Optionally, the spigot can be disposed on a front portion of the upper column.

In one embodiment the spigot is not disposed on a top surface of the dispensing apparatus. Optionally, the upper column is not cylindrical. The upper column can have at least two different radiuses of curvature. The upper column can include two upper doors and the keg compartment can include only one door. Optionally, the upper column can include a cool air entrance opening having a cross-sectional area of at least 24 square inches within which at least a terminal portion of a line lies. The cool air entrance opening can be communicably coupled to an interior of the keg compartment and not to ambient air when a door of the keg compartment is closed and the upper doors are open. Optionally, the cool air entrance opening can be communicable with ambient air when a door of the keg compartment is open, but not when the door is closed.

In one embodiment, the spigot can be rotated about a substantially horizontal axis and/or the spigot can include a quick-couple spigot handle. Optionally, a plurality of spigots can be provided. The keg compartment can include internal dimensions which accommodate a plurality of slim kegs. Optionally, a vent can be disposed in the upper column and can be communicable with an area formed between the one or more upper doors and the upper column.

An embodiment of the present invention also relates to a beverage dispensing apparatus having a keg compartment, an upper column that includes one or more upper doors and a spigot that is concealed when the doors are closed; and the dispenser having an elongated cylindrical shape.

An embodiment of the present invention also relates to a beverage dispensing apparatus having a substantially cylindrical shape; a cooled keg compartment; a first spigot communicably coupled to a keg tap; a second spigot communicably coupled to a water source; and the spigots can be secured within a spigot bay that is formed into a portion of the substantially cylindrical shape.

An embodiment of the present invention also relates to a beverage dispensing apparatus having a keg containing compartment, and an upper column, the upper column having a spigot, wherein an outer portion of the upper column is recessed from an outer portion of the keg compartment, thereby forming a rabbeted shape.

An embodiment of the present invention relates to a method and apparatus for dispensing carbonated beverages with minimal foam by properly maintaining the temperature of the carbonated beverage within a desirable range. The apparatus preferably comprises an enhanced column which provides a greater flow of chilled air to the draft lines within the column. This embodiment can also optionally provide a spigot which can be concealed from view when not in use. Another embodiment of the present invention provides a relatively small foot print, thus requiring less floor space than conventional keg dispensers. One embodiment of the present invention relates to a method and apparatus for dispensing draft beverages e.g. beer, cider, soda, ginger beer, root beer, wine or any other beverage able to be served in through a conventional draft system.

One embodiment of the present invention comprises a keg dispenser. The keg dispenser preferably includes a cylindrical housing which is about 10 to about 24 inches in diameter, and more preferably about 13 to about 15 inches in diameter. The smaller approximate 13" to 15" diameter housing can house a sixth barrel, 5 gallon slim keg or a smaller keg while the larger approximate 15" to 17" in diameter can house either a ¼ slim keg, a slim sixth, a slim 5 gallon, or a smaller keg. Alternatively, larger diameters can be used and will provide desirable results, including the ability to house one or more full-size half kegs, 5 gallon slim kegs, and/or ¼ slim kegs. Optionally, the housing can have a single or double door wide enough and tall enough for the one or more kegs to be inserted into it. The one or more doors can optionally accommodate a keg which is in an upright position.

In one embodiment, a bottom portion of the housing preferably houses a refrigeration unit. Alternatively, the refrigeration unit can be disposed elsewhere on and/or within the housing. In one embodiment, a portion of the housing can have a rabbet incorporated into it. Optionally, the rabbet can be formed between a substantially vertical surface, upon which a spigot can be mounted, and a substantially horizontal surface, on which a drip tray can be formed.

An alternative embodiment of the present invention provides a locking mechanism, thus providing a user with the ability to hide or lock, under key, the equipment used to dispense and house a keg.

Another embodiment of the present invention provides a draft dispenser having the appearance of a water cooler with or without the ability to dispense water either from a water line or refillable water container. While using this embodiment the water dispensing nozzle can be located on the exterior of the dispenser readily available to all.

Another embodiment of the present invention provides a dispenser with the appearance of a beverage container in the shape of a can or bottle. In this embodiment, the appearance can be adapted to simulate an existing product, such as a commercially-available individual-serving-sized canned product of the dispensed beverage which is commercially available, thus building brand-recognition and product identification among consumers.

One aspect of an embodiment of the present invention provides a draft dispenser with the availability of various colors. This will prove to be useful in displaying team spirit as consuming draft beverages is sometimes associated with watching professional and collegiate sports on television.

Yet another embodiment of the present invention provides a spigot that comprises a quick-connect and quick-release mechanism (for example the mechanism can optionally be similar to those used to connect air tools to air hoses). Optionally, a locking mechanism can be incorporated and/or adapted into the quick-connect housing such that the normal placement of the handle connection for the spigot is prevented from being used.

A further embodiment of the present invention provides one or more doors that pivot around a central point to cover the dispenser face and the faucet. The pivot point could be horizontal or vertical depending on preference. This type of door configuration would be beneficial as it would allow for the doors to swivel around or over the dispenser instead of opening outward like normal hinged doors, thus helping eliminate the likely hood of someone walking by and catching themselves or their clothing on the doors causing injury or damage to themselves, their clothing or property.

Another embodiment of the present invention provides a door, or doors, that open automatically whether by mechanical (FIG. 11 C element 180) or electrical means (FIG. 11B element 1107). The door(s) could open by any means including remote control (FIG. 11C element 150), touch, sound, push button, voice, motion, etc. The automated door(s) could be located either at the dispenser face or at the keg access. If two or more doors are utilized, it would be preferable that they open simultaneously for each individual location.

Another embodiment of the present invention provides for a valve of any type, preferably a ball valve located between the keg coupler and the faucet. It would be preferred that this valve would be placed closest to the faucet for obvious reasons. It is also preferred that this valve would be opened by electrical means and controlled by some type of key pad, touch pad, digital display, card reader, thumb print or retinal scanner, voice recognition or any other control device. The purpose of the valve would be to close the flow of beverage to the faucet keeping any unwanted user from gaining access to the liquid contained within. The valve would preferably open quickly and could operate in conjunction with a manual valve placed at the faucet or solely by removing the valve at the faucet so that every time it is opened, liquid is dispensed. Another benefit of this configuration is the ability to connect multiple draft lines to a single faucet. This is preferably done by installing the valves as close as possible and/or on a higher elevation than the faucet so that minimal beverage is left in the line after each beverage is dispensed. By installing buttons, switches or a display of any type including but not limited to LCD, analog, or digital, the user would be allowed to toggle between their choices of beverages simply by imputing their selection which in turn would open the corresponding valve and depending on the configuration, the product would instantly dispense or the user would open the faucet to dispense. One further preferred aspect of this configuration would be the inclusion of a processor and some type of connection to the internet through a hard or internal computer network through a physical or wireless connection such as WIFI to allow for an administrator to monitor and limit or allow use of the dispenser. In this configuration, the end user would be given some type of pin number, badge, magnetic card, key code, a user ID or any other means to identify the user. The administrator would then monitor, limit, allow, manage and control the usage of the dispenser.

A further embodiment of the present invention provides for a flash heater or chiller to be placed within the dispenser. This flash device would be best placed nearest to the faucet for obvious reasons. The purpose of the device would serve to heat or chill the liquid to the consumer's preferred temperature at the time of consumption. This would be preferable over keeping the entire contents of the keg at the same temperature all the time as it would save energy and certain liquids would spoil at higher temperatures while the alcohol would separate from the water in below freezing temperatures in alcoholic beverages. This is especially true with cold brewed coffee which is stored cold and could be served chilled over ice or heated just prior to consumption.

Yet a further element would include part of the evaporator assembly to run underneath the keg compartment between the bottom dispenser wall and insulation to further refrigerate the bottom of the keg and eliminate any heat from the compressor ever reaching the keg or keg compartment.

Yet another embodiment of the present invention provides for a separate chamber with external access for a gas container wherein the tank may be dropped in and connected to the regulator without use of tools such as crescent wrenches, open end box wrenches or any other type of tool. It would be preferable that the chamber would be isolated and insulated from the rest of the refrigerated chamber. The connecter could be any type including quick connect, twist and lock, screw-in, or any other type. Access to the chamber would be preferred but not limited to the upper section of the dispenser. This tank would hold any number of gases including CO2 (carbon dioxide), argon, nitrogen, nitrogen/CO2 blends also known as beer gas, or any other gas used to propel liquids contained in kegs. The gas cylinder would preferably be inverted within the chamber and would have a tube running from the exit nozzle running through the center of the tank to the opposite end so that when the tank is inverted, only gas and not liquid is expelled during operation. This is very important as liquid CO2 could adversely affect the taste of the beverages being dispensed and also could damage the regulator and other equipment.

Still another embodiment of the present invention provides for a means to electronically regulate the pressure of the CO2 used to dispense and to some extent carbonate the liquid stored within the keg dispenser. This would be beneficial as different types of liquid require different pressures for storage and dispensing.

And still another embodiment of the present invention provides for the use of a digital scale connected to the display of the dispenser providing for an estimated level of liquid contained within the keg. Another method would be to incorporate a density scanner or a flow meter into the dispenser.

Another embodiment of the present invention provides for the ability for the dispenser to dispense seltzer water. Seltzer water is very popular with many people and would be easy to make with the all the equipment necessary being already included in the dispenser.

Still another embodiment of the present invention provides for the ability of the dispenser to dispense kegs with bladders. Typically kegs with bladders are dispensed by applying pressure to the bladder by filling the void between the keg housing and the bladder. These kegs are more conducive for home use because of the ability to use any gas to pressure and propel the kegs and the product including the use of every day atmospheric compressed air from any compressor and would relieve the user from having to purchase different gases when dispensing different beverages. These kegs would use modified couplers so the air pumped would not interact with the liquid being dispensed and could have a separate connection for the sole use of the air aside from the coupler used for the dispensing of the beverage.

Yet another embodiment of the present invention provides for a compressor built into the dispenser. It is preferred that the compressor be adjustable, operate quietly and would operate at pressures of about 1 pound per square inch and up. The compressor would preferably be located in the same area as the refrigeration compressor but it is not necessary and could be housed anywhere inside or outside of the dispenser housing. The compressor could operate with or without a holding tank and could be incorporated into the refrigeration compressor if needed by use of manifolds to save space. It would be preferable that the compressor operate under standard A/C power outlet but could be operated by D/C power if needed and that the outlet can be connected to any standard power outlet either directly or by being integrated into the dispenser's power circuit. The compressor could be regulated by a standard pressure regulator but it would be preferable that this function be integrated into the dispenser's processor so that it can controlled electronically by the user.

Still a further embodiment of the present invention provides for the use of manifolds and multiple sources of gas used to propel and/or preserve the liquids held within the kegs. By providing the user options and an easy way to toggle between those options, it would make the dispenser easier to operate and thus more conducive. Different gases require different regulators to control the output pressure of the tanks. For instance, if a user wanted to dispense wine using nitrogen and then switch to beer using CO2, that user would have switch from a Nitrogen regulator to a CO2 regulator. It is preferred but not necessary that these regulators be digital. That task is not only cumbersome and time consuming but would require tools and could cause damage to the regulators and hoses every time the switch is made. A better method would be to install a manifold with inlet and outlet valves which would allow the user to toggle between at least two supplies of gas or air. When a user wanted to switch from Beer back to wine, they would simply close the valve coming from the CO2 and open the one coming from the Nitrogen tank. It is preferred that at least two chambers be provided to house different gasses preferably using digital gauges and regulators if possible along with the compressor for normal air although one chamber would suffice.

And yet a further embodiment of the present invention provides for a mean to sense when the keg container is out of product and automatically stop the dispensing process. This would be beneficial due to the spitting and spewing caused by the product running out which in turn makes messes sometime splashing product all over the user. One method to eliminate this issue is to incorporate a FOB (Foam on Beer) detector into the dispenser currently available for sale from Draft specialty shops. Another and more preferred method would be to incorporate a sensor somewhere between the faucet and the keg coupler that when used in conjunction with a valve placed behind the faucet as previously discussed would cause the valve to automatically close. It would also be preferable to include a warning mechanism in the form of a light or in conjunction with any display that would show when the product was out.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. For example, although the drawings illustrate only circular and oval cross-sectional-shaped housings, desirable results can also be achieved by virtually any cross-sectional shape capable of housing at least one keg of any size. In the drawings:

FIG. 8A is a perspective front view drawing which illustrates a dispenser according to an embodiment of the present invention wherein its doors are closed;

FIGS. 8B-D are top-view drawings which illustrate a dispenser according to an embodiment of the present invention wherein a single ½ keg, two ¼ slim kegs, and three slim sixth barrel or slim 5 gallon kegs are respectively provided;

DETAILED DESCRIPTION OF THE INVENTION

The terms "draft" and/or "kegs", as used throughout the specification and claims, are used for the sake of simplicity and are intended to include any and all pressurized and/or pressurizable containers capable of containing a beverage and/or a component of a beverage.

The terms "line" and "lines", as used throughout the specification and claims, are intended to include any structure, device, product, and/or component for the transmission and/or distribution of a fluid, including but not limited pipes, tubes, hoses, connections, and the like.

The term "column", as used throughout the specification and claims, can be used interchangeably with the term "tower", each of which are intended to include a housing and/or portion thereof, through which the draft lines attaching the spigot to the keg pass and is not limited to any particular shape.

The terms "a", "an", and "the" mean one or more.

Figure 1:
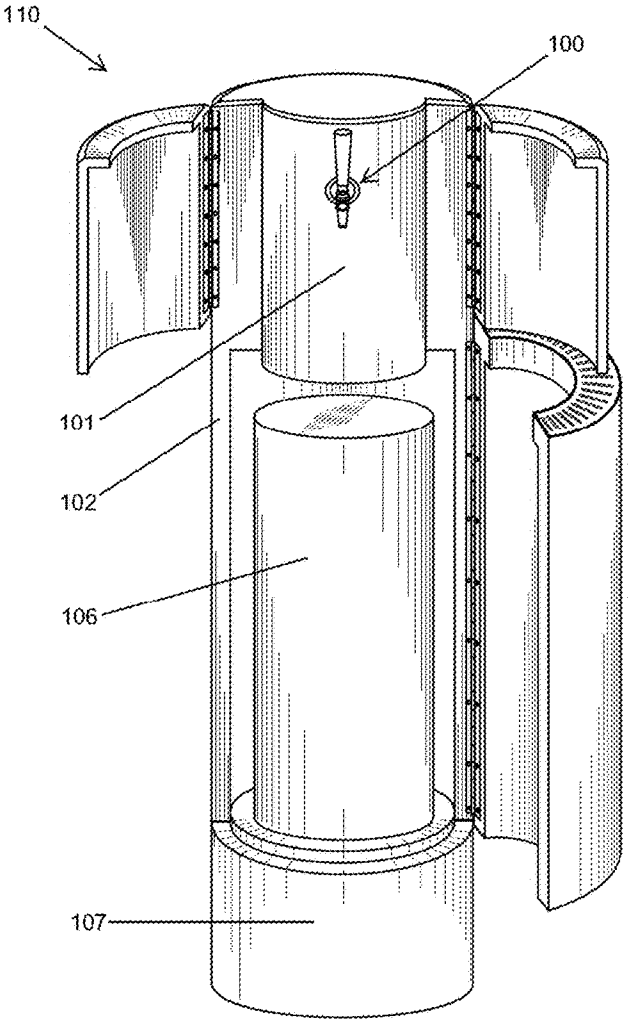
FIG. 1 is a perspective-view drawing which illustrates a dispenser according to an embodiment of the present invention wherein its doors are connected with an internal hinge arrangement and wherein a drip tray is disposed within a top-portion of a lower door thereof.
Figure 2A:
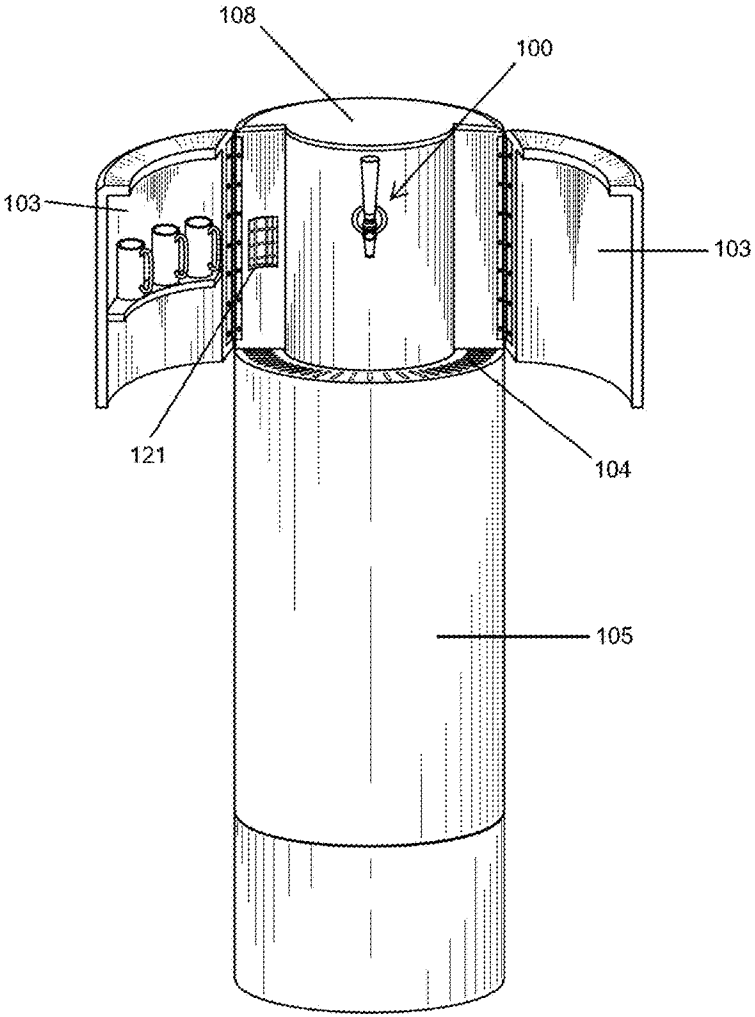
FIG. 2A is a drawing which illustrates an embodiment of the present invention wherein a pair of top doors are open and a door of the keg compartment is closed.
Figure 2C:
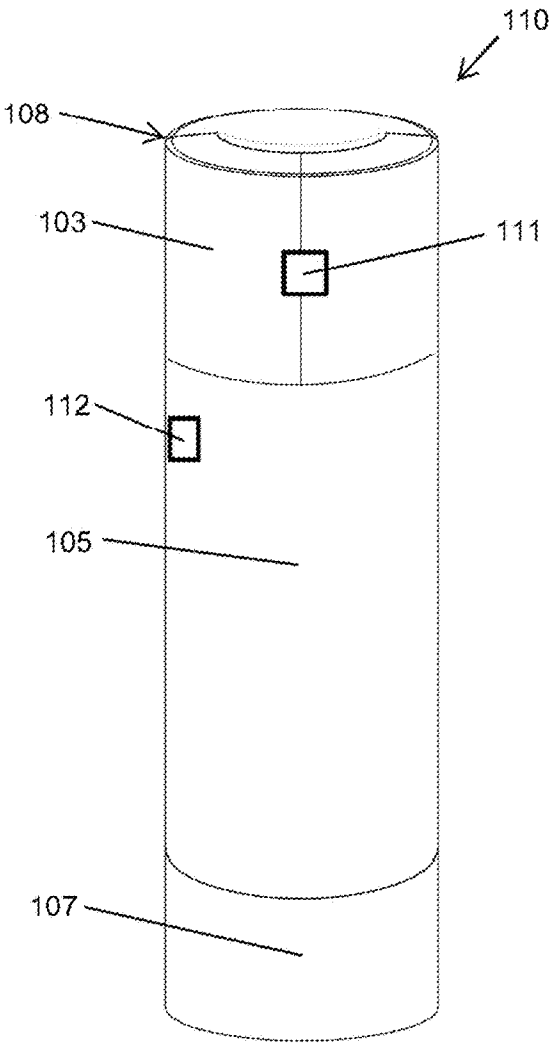
FIGS. 2B and C are drawings which illustrate an embodiment of the present invention; wherein a spigot is concealable within a housing when not in use.
FIGS. 2E and D are drawings which respectively illustrate embodiments of the present invention wherein the dispenser has a bottom door, but not a top door, and wherein the dispenser does not have any doors.
Figure 2B:
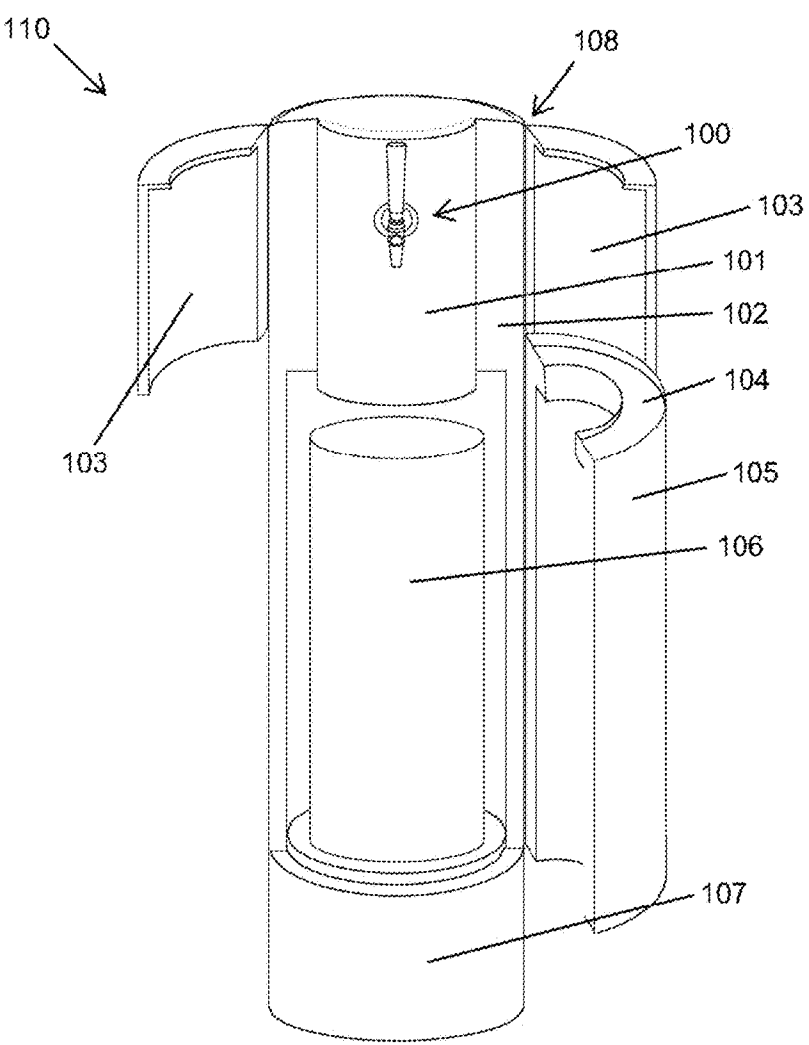

Referring now to FIGS. 1 and 2A-C, an embodiment of keg dispenser 110 is illustrated. In this embodiment, dispenser 110 preferably comprises spigot 100 attached to front portion 101 of upper column 108 of housing 102. Although numerous configurations and designs can optionally be incorporated into upper column 108, as best illustrated in FIG. 1, upper column 108 preferably comprises a large rear section and smaller front portion 101, such that the back portion of upper column 108 preferably comprises a larger diameter than front portion 101. Spigot 100 is preferably mounted on front portion 101. In this embodiment, when upper doors 103 are closed, they thus cause upper column 108 to substantially uniform outside diameter as illustrated in FIGS. 2A-C. In this embodiment, because spigot 100 protrudes from front portion 101 of upper column 108, upper doors 103 preferably comprise a protruding portion about a top portion of their inner radius of curvature, thereby creating an internal void around spigot 100 such that it is concealed when upper doors 103 are closed.

Housing 102 preferably comprises an internal void, which extends from cooling unit housing portion 107 through keg compartment 109 (see FIGS. 3A and 3B and 3C) and up to upper column 108, thereby maintaining a consistent temperature for a beverage traveling through such lines all the way from keg 106 to spigot 100. This ability to maintain a consistent temperature permits the beverage to be uniformly and properly chilled, thereby avoiding temperature-induced foam in carbonated beverages. In one embodiment, upper column 108 comprises cross-sectional internal area 419 (see FIG. 4B) of at least about 16 square inches and most preferably a cross-sectional area of at least about 24 square inches. This large cross-sectional area facilitates the flow of air around the tubing even at its connection to the spigot. The large opening for airflow also provides easy access to the spigot and line connection for maintenance, and repairs on dispenser 110. The draft lines attach form the keg 106 to the spigot 100 and can be of typical size and length according to the application of use.

By placing spigot 100 directly on front portion 101 of upper column 108, instead of on the end of a line which extends from housing 102, direct cooling and ventilation from cooling unit 114 (see FIG. 3), is provided, thus minimizing temperature-induced foam by allowing spigot 100 to be cooled with minimal obstruction, unlike conventional keg dispensers. This configuration also allows for the concealment of the draft-related connections and lines by creating an area built into housing 102 for spigot 100 to attach to.

In one embodiment, front portion 101 of upper column 108 has a frontal diameter of about three to about four inches smaller than the outside diameter of housing 102. By providing a smaller diameter of front portion 101, which is containable within doors 103, not only is spigot 100 concealable, but drip tray 104 can thus also be contained within an upper portion of lower door 105, such that drip tray 104 resides under spigot when lower door 105 is closed. Because drip tray 104 is housed within an upper portion of door 105, when upper doors 103 are closed, not only is spigot 100 concealed, but drip tray 104 is also concealed. In an alternative embodiment, upper doors 103 can be shortened and a drip tray can be incorporated into a portion of housing 102 which wraps around the front of dispenser 110 between the upper doors and the lower door.

Optionally drip tray 104 can include a recess within which a removable drip tray can be disposed. This removable drip tray thus allows for easy cleaning and draining. In an alternative embodiment, drip tray 104 can simply comprise a recess which contains a dripped liquid. In either embodiment, a line can be connected to drip tray 104 such that liquids which are captured by drip tray 104 are led to a predetermined area, which can include a capture container, a sewer drain, and/or a heated evaporating tray.

Optionally, doors 103 can include locking mechanism 111, which aids in keeping unauthorized people, such as children, from dispensing the beverage housed therein. Lower door 105 can also optionally include locking mechanism 112. Although cooling unit 114 (see FIG. 3), and cooling unit housing 107 is illustrated as being disposed below keg compartment 109, it can be placed anywhere within or on dispenser 110 and can rely on any known system, apparatus, mechanism, method, and/or combination thereof capable of cooling a beverage to a desirable temperature, including but not limited to adiabatic cooling of a compressed refrigerant, Peltier-effect-based electro-thermal coolers, evaporative cooling, combinations thereof, and the like. In an alternative embodiment, cooling unit housing 107 can optionally be omitted and the cooling unit instead be incorporated into another portion of housing 102, this is particularly true for diminutively-sized thermo-electric coolers.

In one embodiment, one or more vents 121 (see FIG. 2A) can be provided through upper column 108 which permits chilled air to enter the area between closed doors 103 and front portion 101 of upper column 108. In this embodiment, drinking containers, can be stored within the confines of enter the area between closed doors 103 and front portion 101 of upper column 108. Accordingly, a user can obtain a chilled drinking container stored therein prior to dispensing a beverage from spigot 100 into the glass. Optionally, one or more vents 121 can be replaced with one or more cooling plates, such as a Peltier thermo-electric cooler. This not only provides a user with a pre-chilled glass, if so desired, but the chilled air which accumulates within the confines of the area between closed doors 103 and front portion 101 of upper column 108, when such doors are closed, also chills spigot 100, thus further avoiding thermal-induced foaming of a dispensed beverage. Still further, a pre-chilled glass also reduced thermal-induced foaming and permits the user to maintain a served beverage at a colder temperature for a longer period of time. Optionally, the cooling plates can be disposed below drip tray 104 or by decreasing the size of the drip tray and placing the cooling plates to the sides of the drip tray, such that not only is the internal space between closed doors 103 and front portion 101 of upper column 108 chilled, but also such that while top doors 103 are open, a user can place his or her drinking container on the drip tray, thereby keeping the beverage contained in the drinking container colder for a longer period of time. The apparatus can also be configured so as to only turn on the cooling plates also known as chilling plates when the faucet doors are open in an effort to reduce energy consumption thereby acting as chilling coasters for beverage containers. Optionally, vents 121 can be configured such that they are closed and/or airflow to them is blocked when one or more of doors 103 are opened, thus preventing cooled air from being vented to outside ambient air.

Figure 2E:
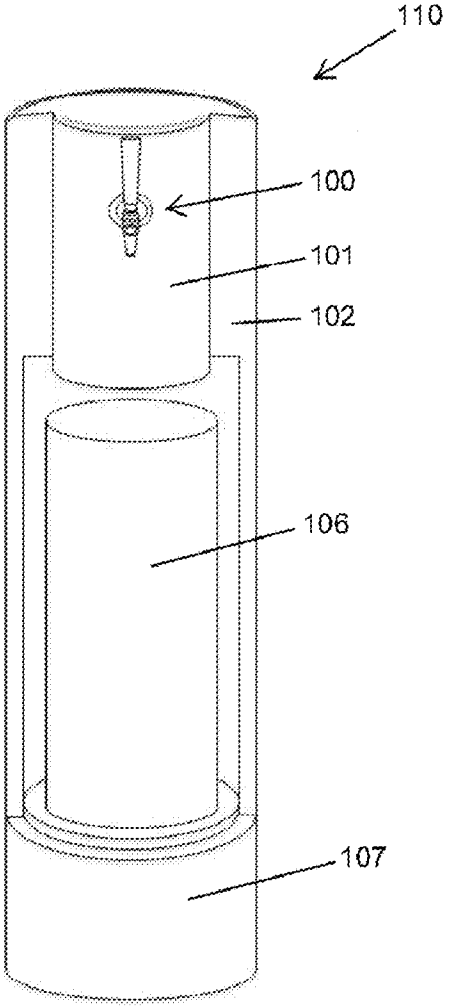
Figure 2D:
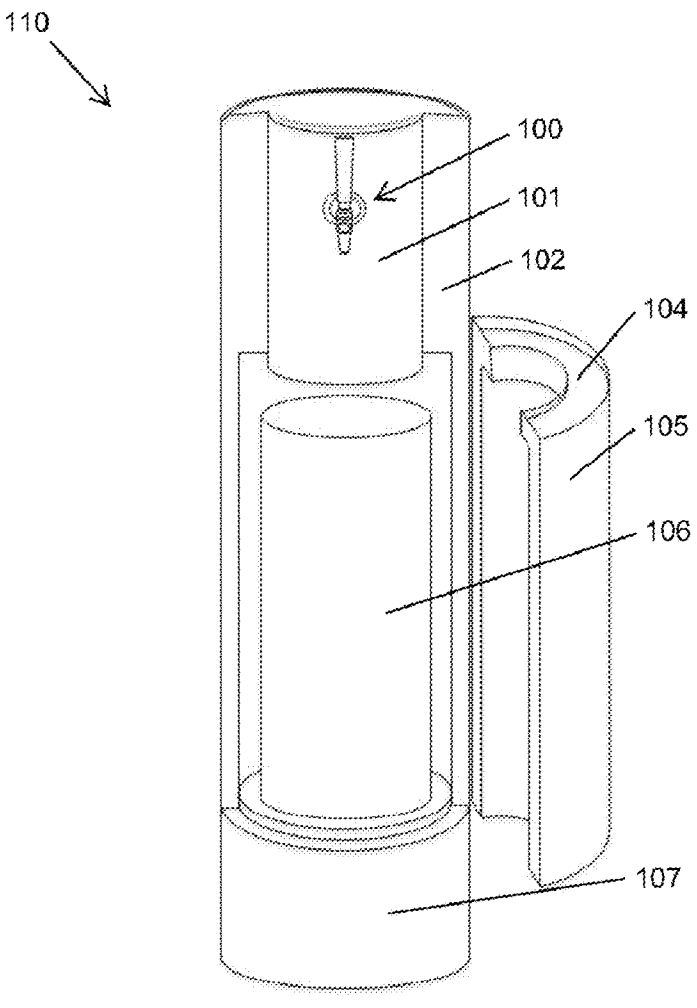

As best illustrated in FIG. 2D, in one embodiment, dispenser 110 can comprise bottom door 105, but no top doors. In this embodiment, spigot 100 remains visible when dispenser 110 is in use and when dispenser 110 is not in use. FIG. 2E illustrates an embodiment of the present invention wherein dispenser 110 does not include keg compartment door 105, nor does it include top doors 103. In one embodiment, dispenser 110 can comprise upper doors 103 but not a compartment door. In one embodiment, keg 106 can be chilled prior to placement into dispenser 110. Optionally, keg 106 can be disposed in an ice bucket or other cooling container and disposed into dispenser 110.

Figure 3C:
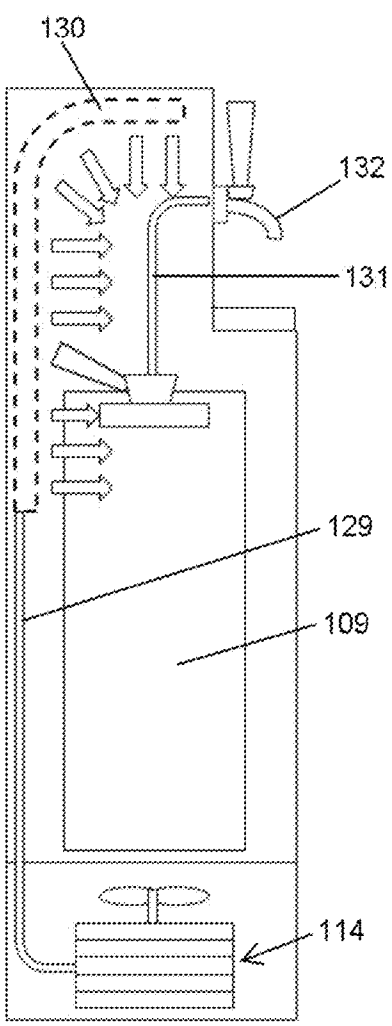
FIGS. 3A, 3B and 3C are drawings which respectively illustrate a flow of chilled air within a dispenser wherein a cooling unit disposed at a bottom and a top of the dispenser according to an embodiment of the present invention.
Figure 3B:
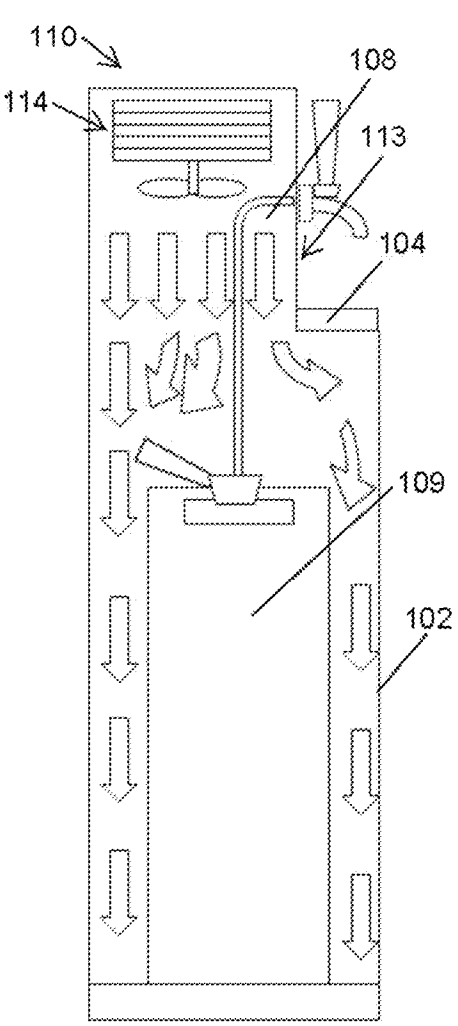
Figure 3A:
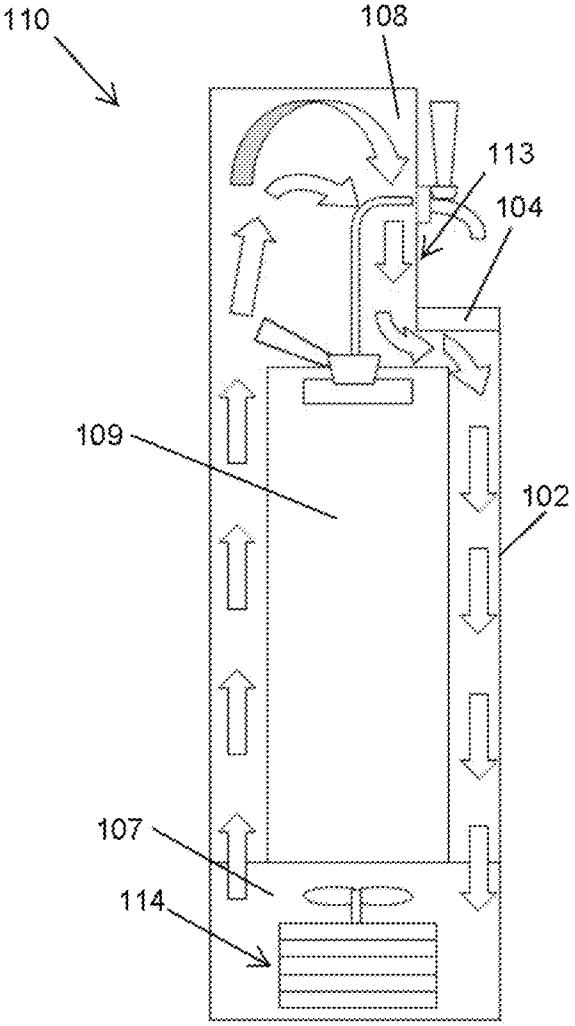

FIGS. 3A and 3B and 3C schematically illustrate the flow of chilled air within dispenser 110 according to an embodiment of the invention. The recessed-configuration of upper column 108, as taught in an embodiment of the present invention, permits its lower portion to remain open to the flow of chilled air, while simultaneously providing a concealable spigot and drip tray. Disposing cooling unit 114 and cooling unit housing 107 at the bottom of dispenser 110 as illustrated in FIG. 3A, allows chilled air to flow throughout housing 102, including through keg compartment 109, thereby chilling not only a keg, but also the beverage distribution lines which connect the keg to a spigot. Alternatively, desirable results are also obtained when cooling unit 114 is instead disposed within upper column 108, as illustrated in FIG. 3B. In this configuration, the chilled air flows down cooling unit 114 through keg compartment 109, before circulating back up to cooling unit 114. Thereby eliminating the need for the cooling unit housing illustrated at the bottom of dispenser 110 in FIG. 3.

In one embodiment of the present invention, wherein top doors 103 are or are not provided, rabbeted shape 113 (see FIGS. 3A and B) is preferably formed due to a lower portion of dispenser 110 protruding further than upper column 108. In one embodiment, rabbeted shape 113 can optionally be formed between upper column 108 and drip tray 104. In one embodiment, front portion 101 of upper column 108 can optionally comprise a substantially planar shape.

Figure 4B:
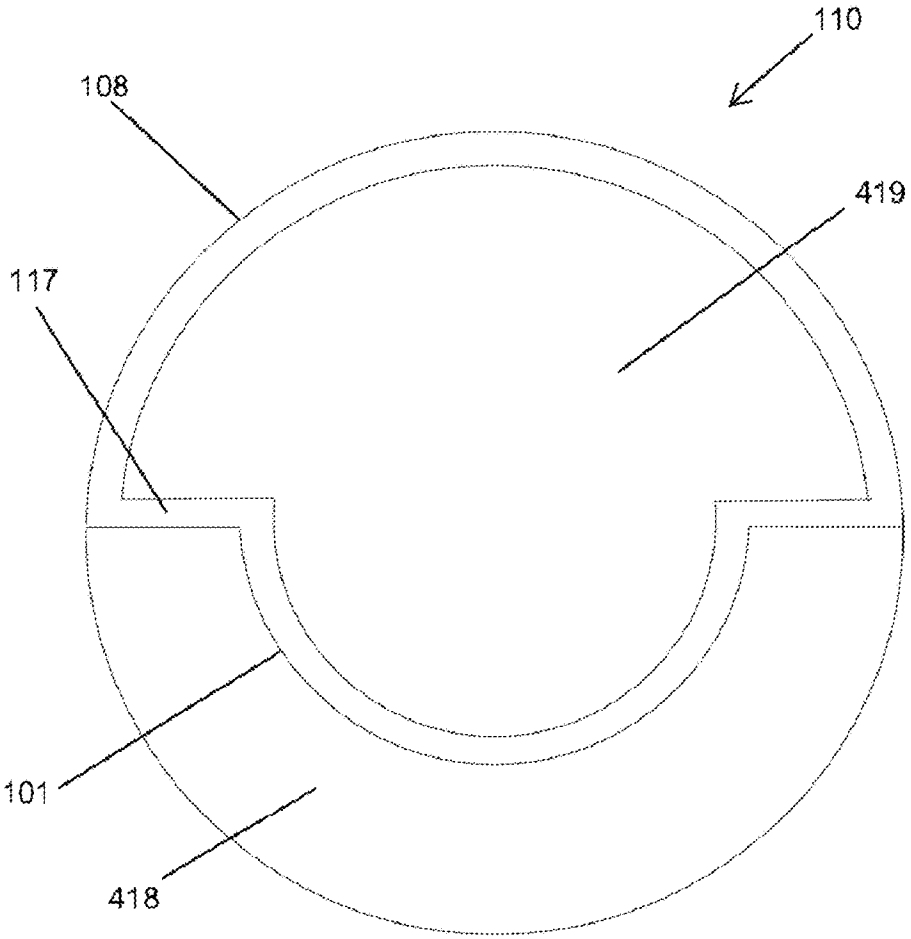
FIGS. 4A and B are drawings which illustrate a size difference between a conventional column and an enhanced column according to an embodiment of the present invention.
Figure 4A:
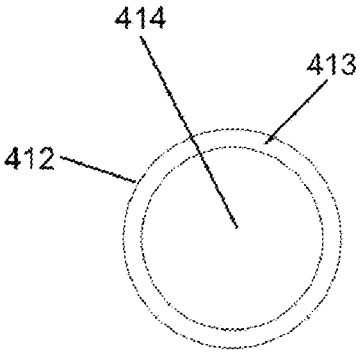

FIG. 3C is an embodiment depicting an enlargement of the upper column making it possible to run a coolant line 129 to the evaporator coils which are located higher up within the dispenser. The coolant line 129 is in communication with the evaporator coil 130 located within the upper column thereby providing improved cooling of the dispensing line 131 which is in communication with the faucet/spigot 132. It is well known that hot air rises and the placement of the evaporator coil 130 higher in the unit would cool the warmer air within the dispenser therefore increasing the convection process possibly eliminating the need for a fan. One aspect of the embodiment is to help reduce temperature hotspots within the dispenser FIG. 4A illustrates a traditional keg dispensing column 412, which has an exterior diameter of about four inches and approximately ½ an inch of insulation 413, thus leaving opening interior 414 of only about three inches diameter for air to flow. Compare this small interior air-flow diameter with the same-scale drawing of an embodiment of dispenser 110 of the present invention as illustrated in FIG. 4B. As illustrated therein, the large size of upper column 108, in conjunction with the smaller-diameter front portion 101 allows for the use of thicker insulation 117 (optionally about one inch thick), without limiting air flow nearly as much as that encountered in conventional keg-dispensers. This configuration also creates seat 418 for the placement of drip tray 104 that can easily be concealed. Further, the smaller diameter front portion 101 of upper column 108 allows for the optional placement of multiple spigots without drastically restricting airflow to the spigots as is encountered in conventional keg-dispensers. This increased flow of chilled air around the lines connecting the one or more spigots, thus reduces the temperature of the beverage contained in the end portion of the lines, thereby allowing the first-served beverage to be colder than that of a typical dispenser, without the need to install an additional blower to force the cold air around the lines.

Figure 5:
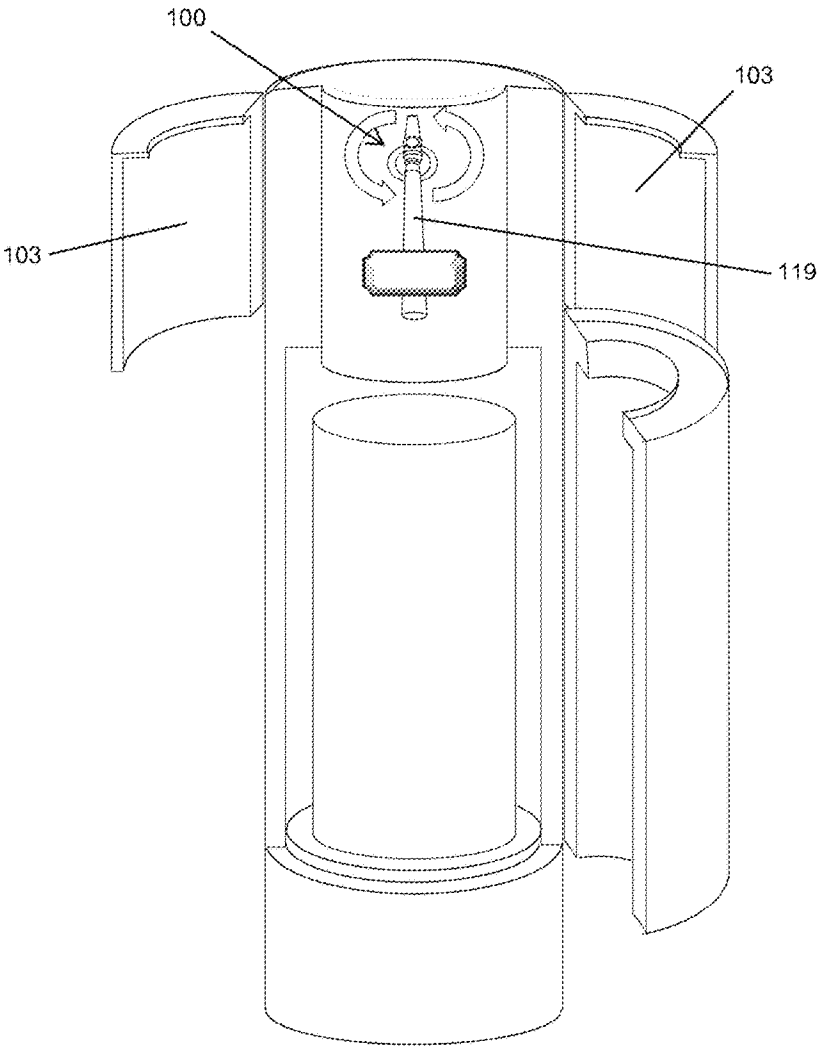
FIG. 5 is a drawing which illustrates a rotatable spigot according to an embodiment of the present invention.

As illustrated in FIG. 5, spigot 100 can optionally be rotationally coupled to accommodate handle 119 having an extended length such that spigot 100 can be rotated to permit handle to reside within the confines created by upper doors 103. In this embodiment, spigot 100 can rotate approximately 180 degrees or more. Optionally, a release mechanism (not shown) can be provided to lock spigot 100 into an up and/or down position. The release mechanism can be any known mechanism.

Figure 6B:
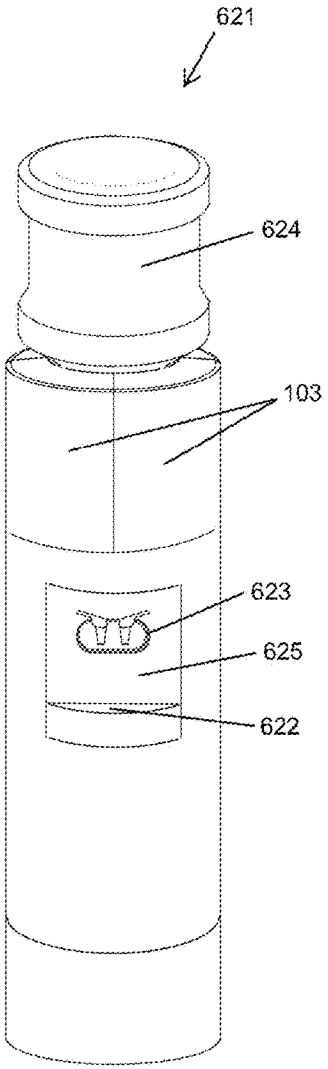
FIGS. 6A and B are drawings which illustrate alternative embodiments of the present invention which incorporate a water dispensing-spigot.
Figure 6A:
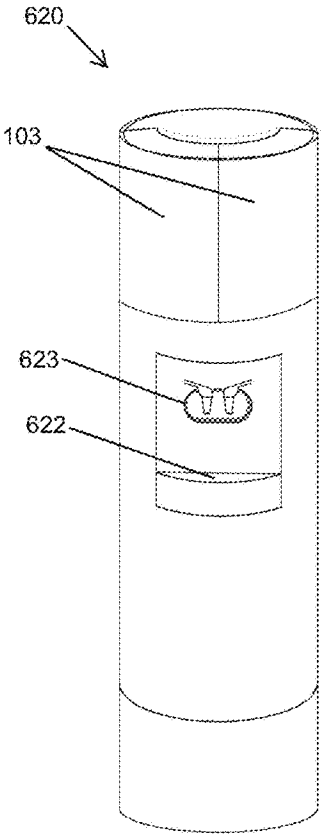

Referring now to FIGS. 6A and B, multi-purpose dispensers 620 and 621 are illustrated in which the dispenser is made to either appear to resemble a conventional water-cooler or actually dispense water in conjunction with a beverage contained in a pressurized and/or pressurizable keg. In the two illustrated embodiments, drip tray 622 and one or more spigots 623, which can resemble spigots on a conventional water-cooler, are placed on the housing door—one or more of which can protrude out slightly. As illustrated in FIG. 6A, if it is desired, a water line, similar to those used in residential refrigerators, can optionally be provided and connected to a filtration system which in turn can be attached to dispenser 620. As illustrated in FIG. 6B, water bottle 624 can optionally be connected to an input tap disposed in an upper end of dispenser 621, including but not limited to conventionally known water-cooler systems. In each of these embodiments, water can optionally be dispensed from one of the spigots and a beverage from a keg can be dispensed from the other. Optionally, a cooling compartment can be provided within either of dispensers 620 or 621, such that chilled water can be dispensed. Spigots 623 are optionally disposed within spigot bay 625. Optionally, in one embodiment, dispenser 620 and/or 621 can optionally include one or more upper doors 103, which can be opened to reveal a spigot which dispenses beverage from a keg contained within the dispenser. In this embodiment, a user can optionally have a plurality of water spigots in an open and conspicuous spigot bay 625, such that dispenser 620 and/or 621 can resemble a functioning and conventionally-shaped water-cooler, while simultaneously functioning as a keg dispenser. Optionally, the water supply can be disconnected from the spigots in spigot bay 625 such that those spigots do not operate or such that one or more of them dispense beverage from a keg contained within dispenser 620 and/or 621.

Figure 7B:
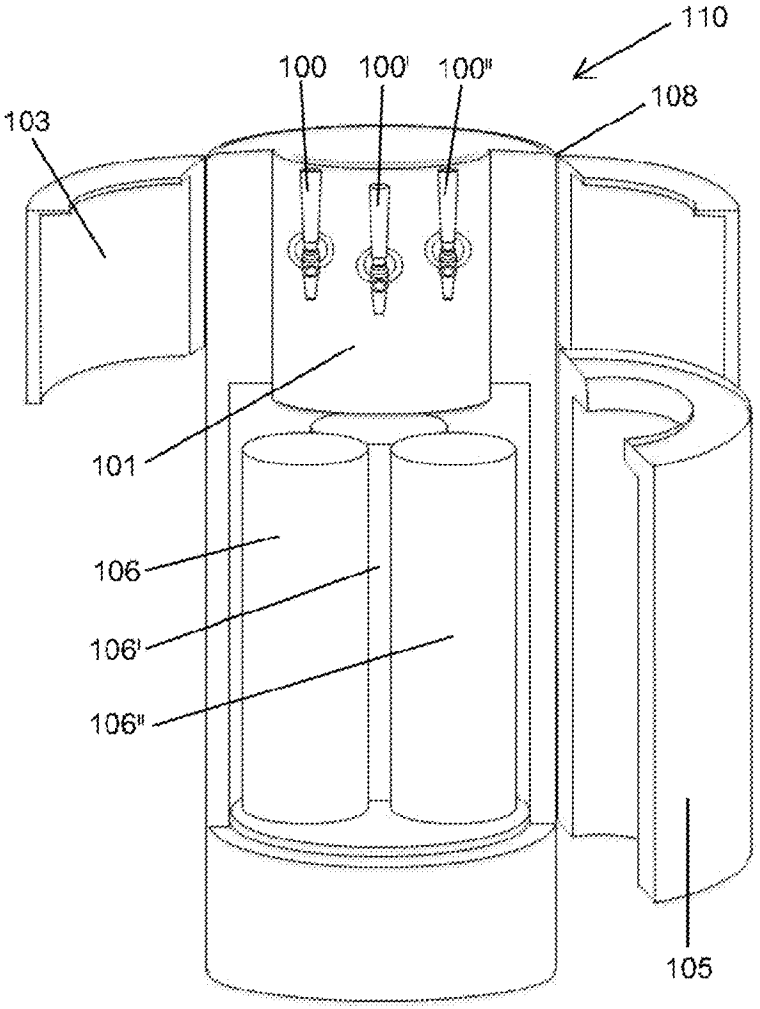
FIGS. 7A and B are drawings which illustrate a dispenser according to an embodiment of the present invention which is capable of housing a plurality of spigots and kegs, wherein the doors of the housing are respectively closed and open.
Figure 7A:
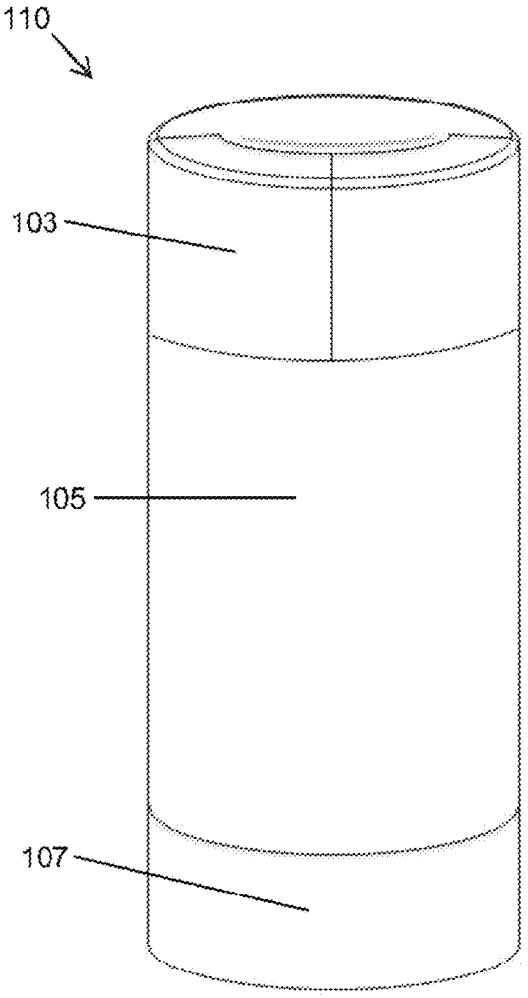

Referring now to FIGS. 7A and B, according to yet another embodiment of the present invention, foam resistant keg dispenser 110 can be provided with an increased diameter in order to dispense one ½ barrel keg, or multiple slim kegs 106, 106' and 106". In this embodiment, the increased diameter of dispenser 110 also increases the size of front portion 101 of upper column 108, thus permitting a plurality of spigots 100, 100', and 100" to be accommodated. Still further, the increased diameter of dispenser 110 also increases the cross-sectional area of upper column 108, which in turn permits multiple tap lines to be contained while simultaneously increasing the amount of chilled air-flow thereto.

FIG. 8A illustrates a front-perspective view drawing of an embodiment of dispenser 110 similar to that illustrated in FIGS. 7A and B, except that instead of the substantially circular cross sectional shape illustrated in those Figs, the embodiment of dispenser 110 illustrated in FIGS. 8A-D instead comprises a more oval-shaped cross sectional shape. FIG. 8B is a top view drawing which schematically illustrates the placement of a single large keg 800, a pair of smaller kegs 802, and a trio of smaller kegs 804. For example, in one embodiment, dispenser 110 can comprise an oval shape and can accommodate a ½ keg, a pair of ¼ slim kegs, or a trio of ⅙ slim kegs. As illustrated, the oval-shaped cross section shape helps reduce the footprint of dispenser 110 while still permitting it to accommodate several different combinations of kegs and while still maintaining an aesthetically-attractive appearance.

Figure 9:
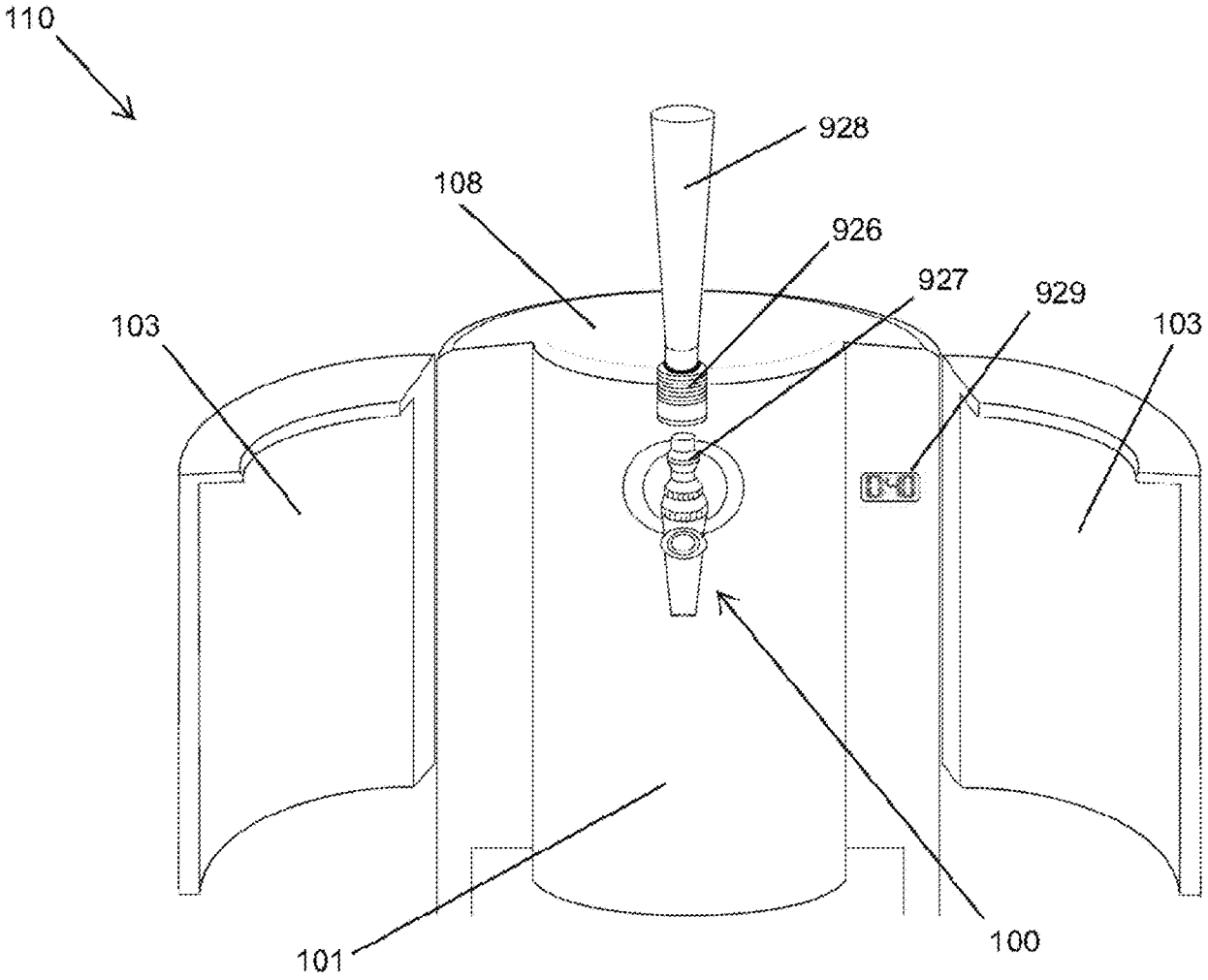
FIG. 9 is a drawing which illustrates an upper column of a dispenser according to an embodiment of the present invention wherein the spigot comprises a removable handle.
Figure 10A:
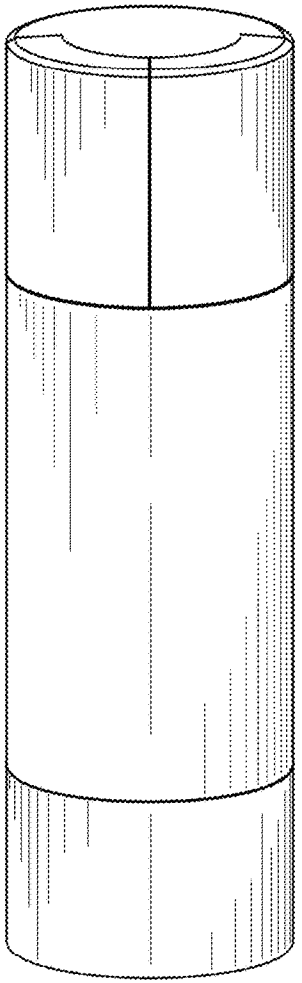
FIGS. 10 A-G respectively illustrates a perspective front view, front and back views, left and right-side views, as well as top and bottom views of an ornamental embodiment of a keg dispenser according to an embodiment of the present invention.
Figure 10C:
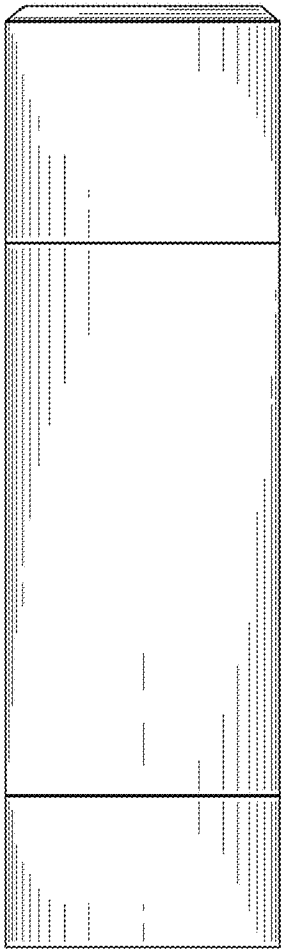
Figure 10B:
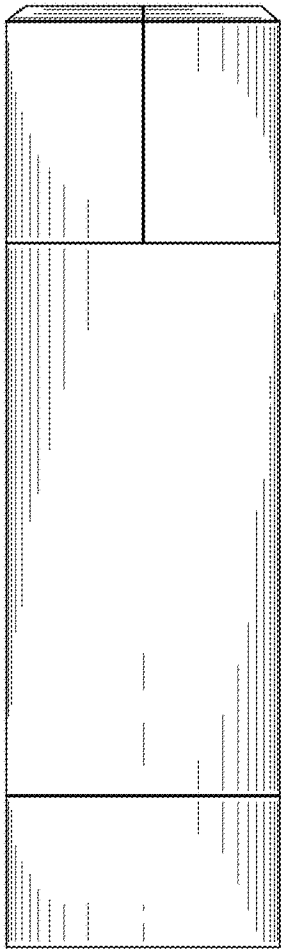
Figure 10E:
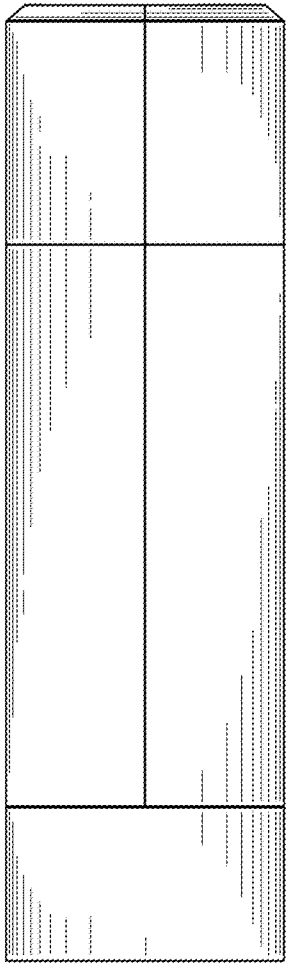
Figure 10D:
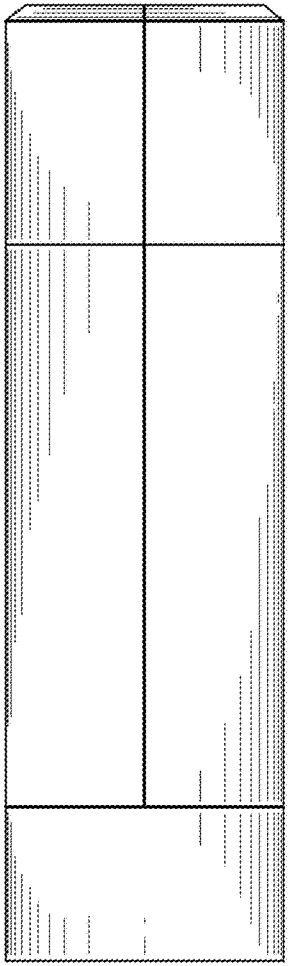
Figure 10F:
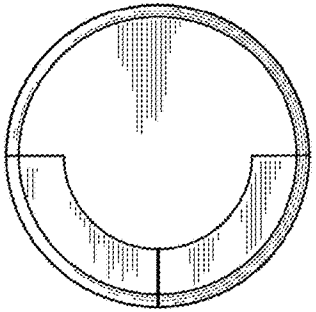
Figure 10G:
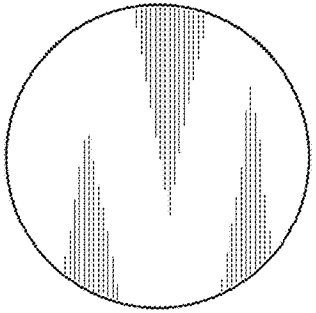

Referring now to FIG. 9, in one embodiment, dispenser 110 can comprise spigot 100 having a removable-connectable handle 928. Optionally, handle 928 can comprise a female coupler 926, which can be a quick-connect coupler, while spigot 100 can comprise a male coupler 927, which can also be a quick-connect coupler, or vice-a-versa. This configuration allows for the easy connection and disconnection of the tap handle 928 to spigot 100. This arrangement also provides the ability to install spigot 100 higher up on front portion 101, while still permitting upper doors 103 to be closed after handle 928 is removed. This is favorable because it allows for the use of taller glassware. Alternatively, disposing spigot 100 nearer the top of front portion 101 permits top cylinder 108 to be shortened, thus reducing the overall height of dispenser 110. Still further, a locking mechanism (not illustrated) can be attached directly on the spigot itself covering the male coupler and having a keyed release mechanism such that spigot 100 cannot be operated without the proper key.

Figures 11A, 11B, 11C:
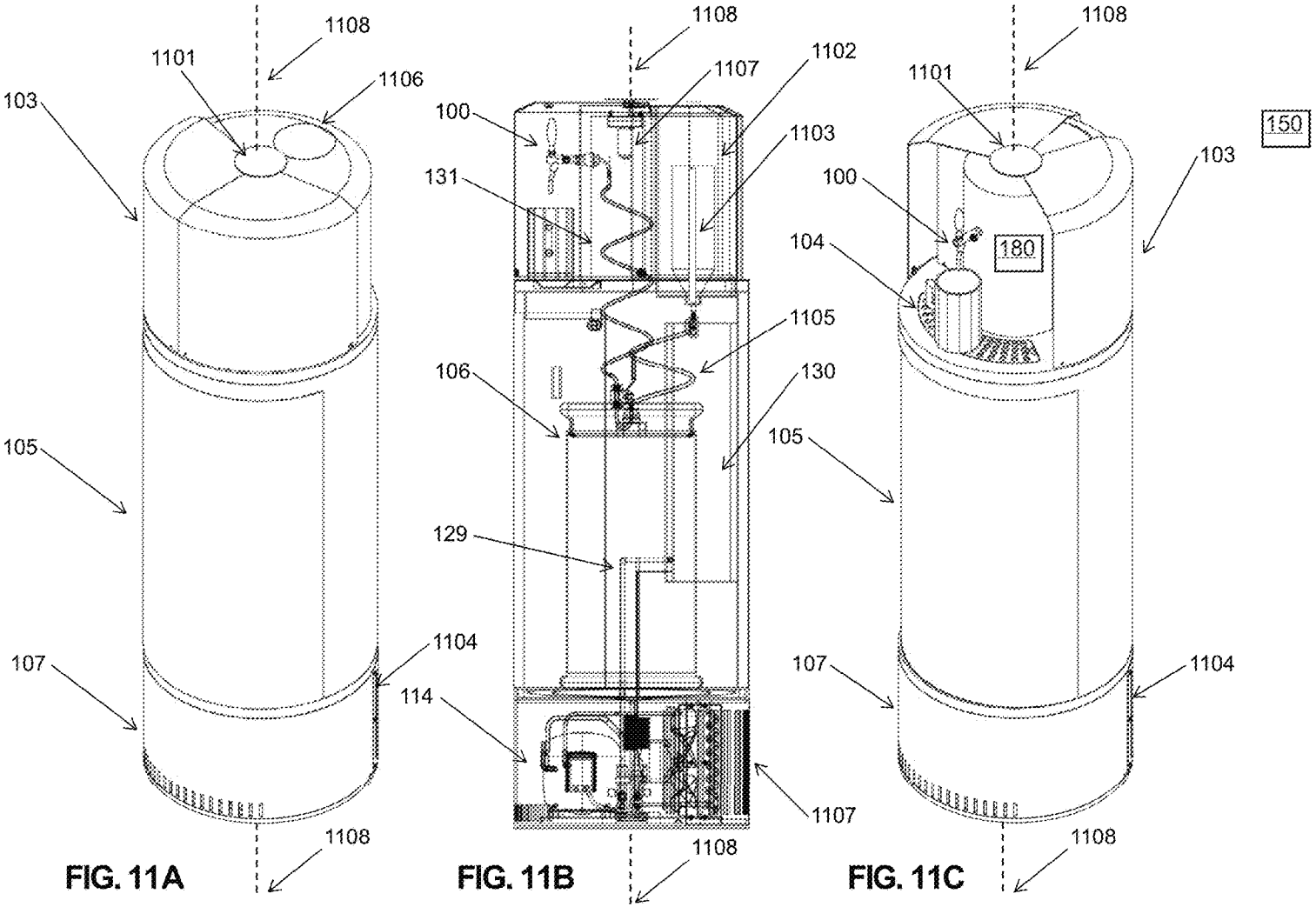
FIGS. 11 A-C respectively illustrates a perspective 3 dimensional and side view of the keg dispenser according to an embodiment of the present invention where in the upper doors pivot around the dispenser column.

FIGS. 11A, 11B and 11C depicts yet another embodiment of the present invention wherein the upper doors 103 open by pivoting on a central pivot 1101 about the vertical axis 1108. The upper doors 103 open around the upper column in an effort lessen the footprint of the dispenser during use and to decrease the likelihood of someone catching the edges of the doors while they are open with their clothing or body parts thus incurring injury to one's person or damage to the dispenser itself. The initiation and physical opening of upper doors 103 would be preferably done by an automated action which would include mechanical, electronic, hydraulic, mechanism or any other means. Although all means described are sufficient, it would be preferred that an electrical mechanism 1107 such as an electrical motor or motors 1107 through direct power or gears would power the opening and closing of the doors. It would also be preferable that some type of sensor be set in place to stop or reverse the doors from closing or opening if anything obstructs or impedes them while in the process. Any type of sensor will due including but not limited to amp meter, magnetic field sensor and motion.

The CO2 chamber preferably located in the upper portion of the dispenser housing who's entrance door 1106 is preferably located on top of the dispenser housing would be designed for easy access and to easily install and remove the CO2 tank or cartridge 1102 which is connected to the keg coupler by way of the CO2 supply line 1105 which in turn is connected to the keg 106. The CO2 tank could be any type ranging in size and style from those used in paintball guns containing only a few ounces of gas to standard sized tanks or cylinders used to propel standard kegs measured in pounds. It would be preferred that whichever tank is used, it would be outfitted with a tube 1103 extending from the tank connector which sits on top of the tank when upright and almost runs the entire length of the tank and ends near the bottom. The purpose of tube 1103 is to allow for the tank to be inverted making it easier to use a more convenient method to connect the tank to the CO2 supply line 1105 as opposed to standard methods which require tools and waste time to connect. The pressure regulator not pictured would be located somewhere between the CO2 tank and the keg coupler.

Figure 12B:
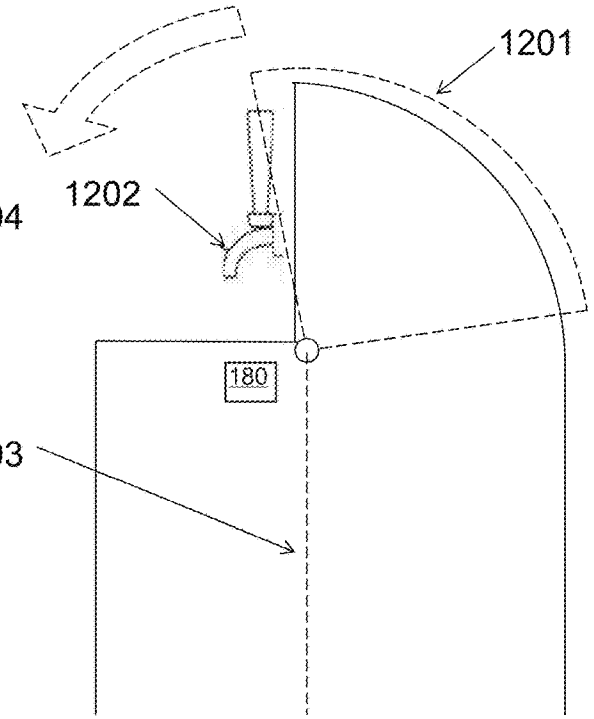
FIGS. 12 A and B respectively illustrates a perspective front and side views of the keg dispenser according to an embodiment of the present invention where in the doors pivot over the dispenser column.
Figure 12A:
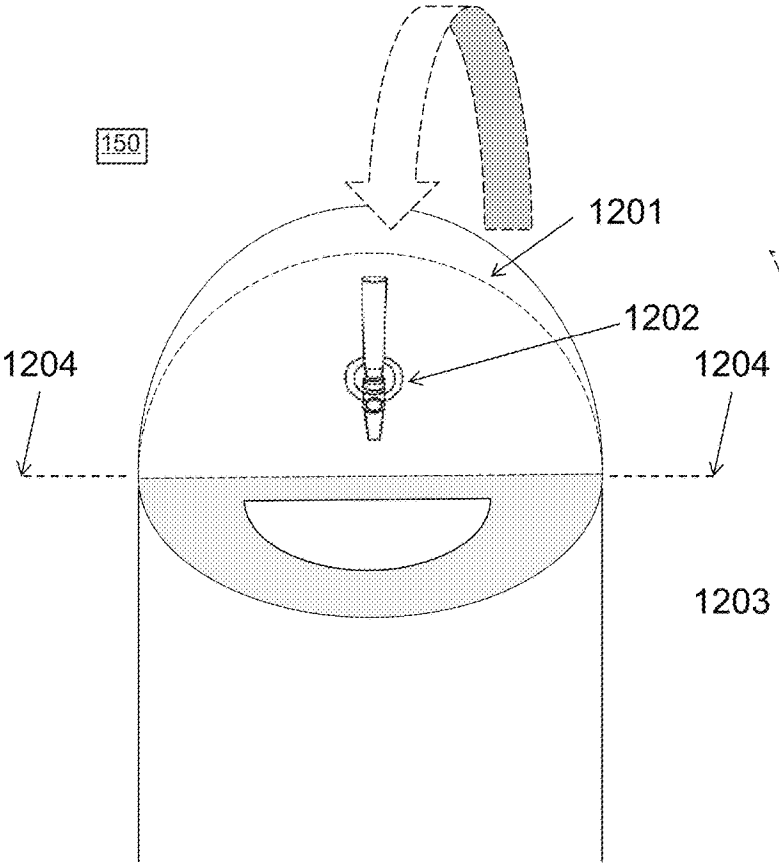

FIGS. 12A and 12B represents yet another embodiment of the present invention wherein the faucet doors 1201 open by pivoting on a horizontal axis 1204 which would preferably run along the center of the vertical cross section 1203 over the upper column of the dispenser to conceal the faucet 1202. Although it is not necessary, it is preferred that the doors open and close using a geared assembly powered by an electrical mechanism or mechanical mechanism 180 (FIG. 12 B) one or more electric motors or by direct drive of such motors. If no motors are used, then the gears would work to open the doors in unison when one of the doors is opened. A remote controller 150 (FIG. 12A) can control the electrical mechanism or mechanical mechanism.

Figures 13A, 13B:
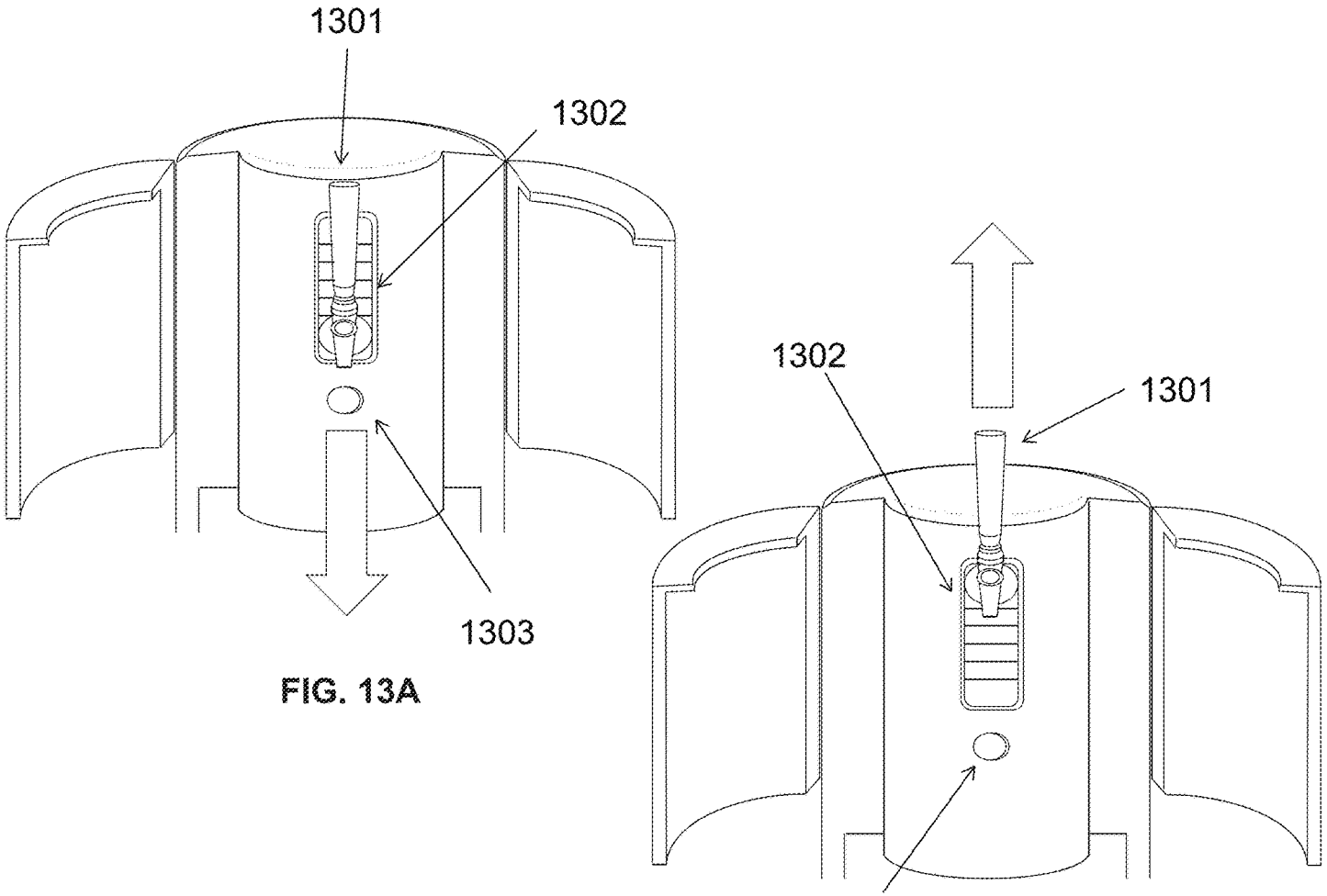
FIGS. 13 A and B illustrates the ability of the faucet assembly to move up and down on a glide mechanism.

FIGS. 13A and 13B depicts yet another embodiment of the present invention wherein the faucet 1301 is able to slide up and down on a glide assembly 1302 when release mechanism 1303 is pressed and is locked into position when depressed. The release mechanism and glide assembly may be comprised of any available. This configuration would be beneficial in allowing for a more compact design of the dispenser and simultaneously allowing for the use of taller glassware or pitchers. Although not pictured it would be of some benefit if the entire upper column would telescope up and down and would offer at least the same benefit as the faucet being able to move up and down.

Cooling unit housing 107 preferably contains an access panel 1104 which is preferably located in the bottom rear of the dispenser in order to access some of the components of the dispenser such as the compressor 114 and condensing coils 1107. It would be preferable that other desirable components such as a flash chiller and heater (not pictured) be located in the upper chamber near the faucet along with the valve that impedes or allows the flow of beverages to the faucet. All of the components required to make seltzer are already contained within the invention as it stands, it is just a matter of arranging them in a preferred manner.

With the ability to quickly connect and disconnect handle 928, a user can also optionally keep a plurality of color-coded couplers, spigots, and/or tap handles, thereby providing a manner to ensure that proper tap handles are attached to the proper spigot, particularly for those embodiments which provide a plurality of spigots.

Still another embodiment of the present invention provides a user with the ability to monitor temperature and/or remaining quantity of a beverage remaining within the keg. The temperature can be monitored via the use of one or more temperature sensors and the one or more temperature levels can be displayed on display 929 (see FIG. 9), which can optionally include a liquid-crystal display, a light-emitting-diode display, or another electrical display apparatus. The remaining capacity of the keg can optionally be determined by a pressure sensor which compares the actual weight of the keg and its contents to a weight of an empty keg. The keg fluid level can be displayed on display 929. In an embodiment wherein both temperature and keg-levels are displayed, they can optionally both be displayed on display 929, or can be displayed to separate display devices.

Referring now to the figures generally, in one embodiment, hinges for one or more of doors 103 and/or 105 are preferably concealed when closed. In one embodiment, spigot 100 is not disposed on a top surface of dispenser the dispenser or on a top surface of upper column 101. In one embodiment, the dispenser is not cooled by, nor does it rely on ice or another substance that is cooled prior to placing it within dispenser 110. In one embodiment, upper column 101 is not cylindrical. In one embodiment, the cooling unit of the invention comprises only a single fan for circulating cooled air and does not comprise an additional blower for forcing chilled air into an area surrounding tap lines. In one embodiment, keg 106 can comprise any ready-to-drink beverage. Optionally, keg 106 can comprise any ready-drink-carbonated beverage. In one embodiment, keg 106 does not comprise a bag-in-a-box or a component thereof.

FIGS. 10 A-G respectively illustrate a perspective front view, front and back views, left and right-side views, as well as top and bottom views of an ornamental embodiment of a keg dispenser according to an embodiment of the present invention.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above and/or in the attachments, and of the corresponding application(s), are hereby incorporated by reference.

What is claimed is:

1. A beverage dispensing apparatus comprising:

an upper cylindrical column, said upper column comprising:

one or more curved doors around the upper column said one or more doors pivot around the exterior of the upper column on a central pivot placed on a vertical axis of the dispenser; and a spigot, said spigot concealed when said one or more doors around the upper column are closed; and an opening for placing a CO2 tank into the dispenser, said opening concealed when said one or more doors are positioned over the opening; and a keg compartment, wherein the vertical axis is in a center of the dispenser and wherein the upper column rests on a lower column and wherein a circumference of the upper column is smaller than a circumference of the lower column and wherein the one or more curved doors pivot around the exterior of the upper column at the circumference of the lower column.

2. The beverage dispensing apparatus of claim 1 further comprising:

a chamber wherein said chamber accommodates a $CO_2$ tank wherein said $CO_2$ tank is inverted.

3. The beverage dispensing apparatus of claim 1 wherein said spigot is positionable higher or lower on the upper column at the discretion of the user.

4. The beverage dispensing apparatus of claim 1 wherein said spigot houses two dispensing lines and is able to dispense two or more beverages.

5. The beverage dispensing apparatus of claim 1 further comprising:

a flash chiller wherein at the point of dispense the flash chiller is activated in order to dispense liquids at colder temperature than what they are stored.

6. The beverage dispensing apparatus of claim 1 wherein said one or more doors automatically pivot open or close at the discretion of a user to expose or conceal said spigot or a keg compartment.

7. The apparatus of claim 6 wherein the one or more doors open under the control of one or more motors.

8. The apparatus of claim 7 wherein the one or more motors are initiated by mechanical mechanism.

9. The apparatus of claim 7 wherein the one or more motors are initiated by electrical mechanism.

10. The apparatus of claim 7 wherein the one or more motors is controlled remotely by a remote control.

* * * * *